US009770621B2

(12) United States Patent
Zannini

(10) Patent No.: US 9,770,621 B2
(45) Date of Patent: Sep. 26, 2017

(54) EXERCISE DEVICE AND ASSOCIATED METHODS

(71) Applicant: Anthony A. Zannini, Pembroke Pines, FL (US)

(72) Inventor: Anthony A. Zannini, Pembroke Pines, FL (US)

( * ) Notice: Subject to any disclaimer, the term of this patent is extended or adjusted under 35 U.S.C. 154(b) by 0 days.

(21) Appl. No.: 14/956,688

(22) Filed: Dec. 2, 2015

(65) Prior Publication Data

US 2017/0157456 A1 Jun. 8, 2017

(51) Int. Cl.

| | |
|---|---|
| ***A63B 26/00*** | (2006.01) |
| ***A63B 21/00*** | (2006.01) |
| ***A63B 23/02*** | (2006.01) |
| ***A63B 23/04*** | (2006.01) |
| ***A63B 21/068*** | (2006.01) |
| ***A63B 21/045*** | (2006.01) |

(52) U.S. Cl.

CPC .... *A63B 21/4047* (2015.10); *A63B 21/00069* (2013.01); *A63B 21/045* (2013.01); *A63B 21/068* (2013.01); *A63B 21/159* (2013.01); *A63B 21/4035* (2015.10); *A63B 23/0211* (2013.01); *A63B 23/04* (2013.01); *A63B 2208/0214* (2013.01)

(58) Field of Classification Search

CPC ..... A63B 21/4047; A63B 21/4035; A63B 21/00069; A63B 21/068; A63B 21/159; A63B 21/045; A63B 23/0211; A63B 23/04; A63B 2208/0214

See application file for complete search history.

(56) References Cited

U.S. PATENT DOCUMENTS

| | | | | |
|---|---|---|---|---|
| 2,642,288 | A | 6/1953 | Bell | |
| 2,924,456 | A | 2/1960 | Miller | |
| 5,366,428 | A * | 11/1994 | Liao | A63B 69/04 482/57 |
| 5,458,553 | A * | 10/1995 | Wu | A63B 21/0615 482/57 |
| 6,984,196 | B2 * | 1/2006 | Tornabene | A63B 21/068 482/140 |
| 7,201,709 | B1 | 4/2007 | Pebbles, Jr. | |
| 7,294,099 | B2 | 11/2007 | Schenk | |
| 7,591,773 | B2 | 9/2009 | Weir et al. | |
| 7,878,957 | B1 | 2/2011 | Chen | |
| 8,632,446 | B2 * | 1/2014 | Solow | A63B 21/023 482/130 |
| 2007/0021280 | A1 | 1/2007 | Tyree | |
| 2008/0015091 | A1 * | 1/2008 | Tyree | A63B 21/04 482/79 |
| 2014/0121070 | A1 | 5/2014 | Ellis | |
| 2016/0129304 | A1 * | 5/2016 | Giannelli | A63B 21/078 482/98 |
| 2016/0236027 | A1 * | 8/2016 | Bastyr | A63B 21/068 |

* cited by examiner

*Primary Examiner* — Loan H Thanh
*Assistant Examiner* — Megan Anderson
(74) *Attorney, Agent, or Firm* — Kevin P. Crosby; GrayRobinson, P.A.

(57) ABSTRACT

Disclosed is an exercise device comprising a body portion for supporting a user, a user support rod pivotally connected to the body portion, and a leg support system operably connected to the body portion for engaging the legs of the user. In one embodiment, the user support rod is pivotally connected to the body portion at a position below that which supports the user, thereby enabling the user to achieve a greater range of motion as compared to existing devices.

20 Claims, 8 Drawing Sheets

EXERCISE DEVICE AND ASSOCIATED METHODS

TECHNICAL FIELD

This disclosure relates to a new and improved exercise device and associated methods of use. More particularly, the embodiments presented herein relate to a device and method for strengthening a user's hamstrings, leg muscles, and other core abdominal muscles.

BACKGROUND OF THE INVENTION

Exercise devices are known in the art. For example, U.S. Patent Application Publication 2007/0021280 to Tyree discloses an exercise device that can be used for primarily exercising a user's leg muscles. However, known devices, such as that disclosed by Tyree, are often not optimized for enabling a user to achieve the greatest possible range of motion for more fully strengthening their leg, and other, muscles. For example, Tyree discloses a device comprising a pivoting support that is connected to the device at a position on substantially the same plane as that which supports the user. Such an orientation limits the user's total range of motion, thereby providing a less than optimal exercise experience. The embodiments of the invention disclosed herein are aimed at overcoming these and other limitations in the art.

SUMMARY OF THE INVENTION

Disclosed herein is an exercise device and associated methods of use, an embodiment of the device comprising a body portion for supporting a user, the body portion having a pair of adjacent forward-facing protrusions defining an elongate slot, a user support rod pivotally connected to the body portion and adapted for pivoting into the elongate slot, and a leg support system operably connected to the body portion for engaging the legs of the user.

The embodiments of the invention disclosed herein have several important advantages. For example, one advantage of the embodiments disclosed herein includes providing a device and method for strengthening a user's leg and abdominal muscles.

Another advantage of the embodiments disclosed herein includes providing an exercise device for the more effective strengthening of a user's hamstrings as compared to known devices.

Yet another advantage of the embodiments disclosed herein includes providing a safer way for a user to strengthen their hamstrings as compared to other known methods.

Still yet another advantage of the embodiments disclosed herein includes reducing exercise-associated injuries resulting from over-extension of a user during exercise.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

DETAILED DESCRIPTION OF THE DRAWINGS

Figure 1A:
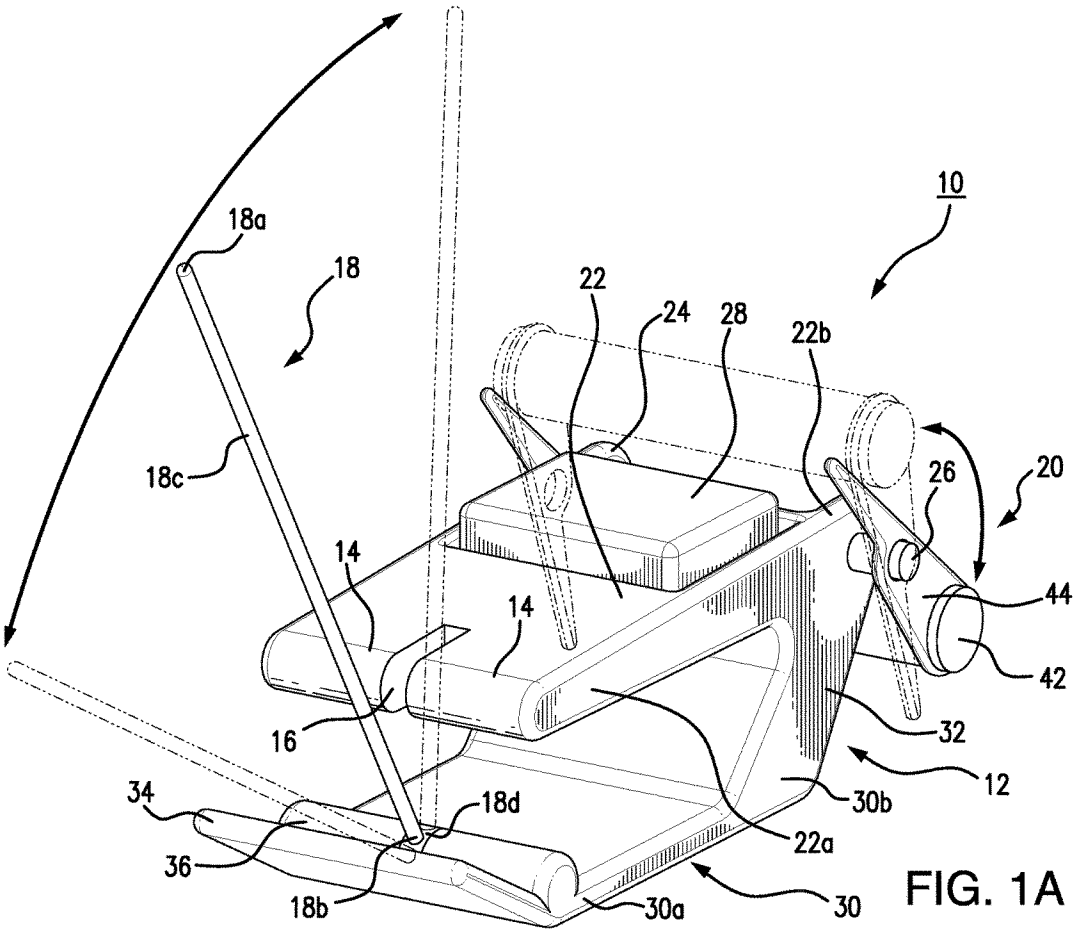
FIG. 1A is a left side perspective view of an embodiment of the present invention.

The present invention relates to an exercise device and associated methods for strengthening a user's hamstrings. The various components of the preferred embodiment of the present invention, and the manner in which they interrelate, are described in greater detail hereinafter.

In the embodiment depicted in FIGS. 1-6, the exercise device 10 comprises a body portion 12 for supporting a user. The body portion 12 may include a pair of adjacent forward-facing protrusions 14 defining an elongate slot 16, the function of which will be described in greater detail hereinafter. The device 10 may also include a user support rod 18 pivotally connected to the body portion 12 and adapted for pivoting into the elongate slot 16. In one embodiment, described in greater detail below, the device 10 also includes a leg support system 20 operably connected to the body portion 12 for engaging the legs of the user.

Figure 1B:
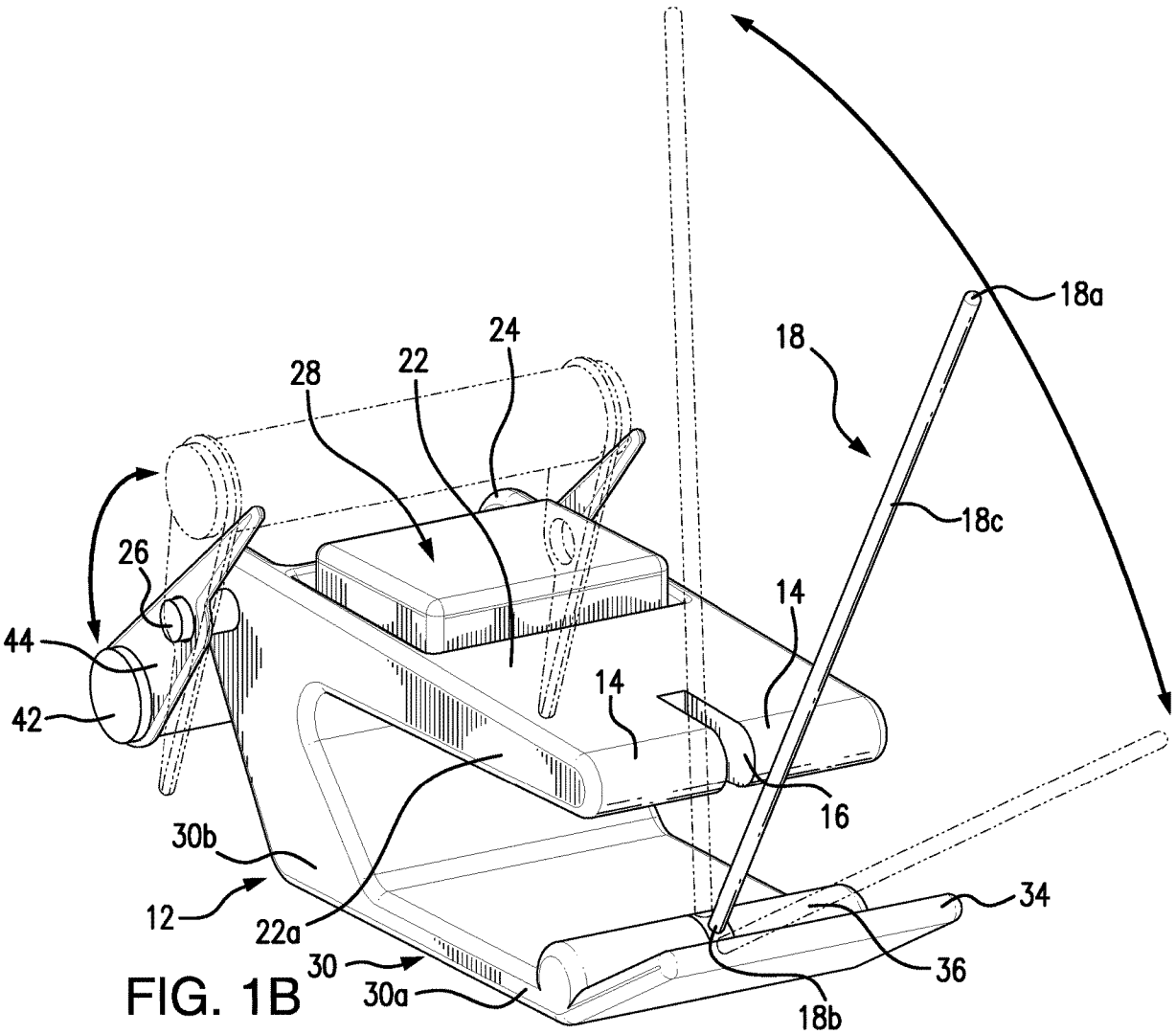
FIG. 1B is a right side perspective view of an embodiment of the present invention.
Figure 2:
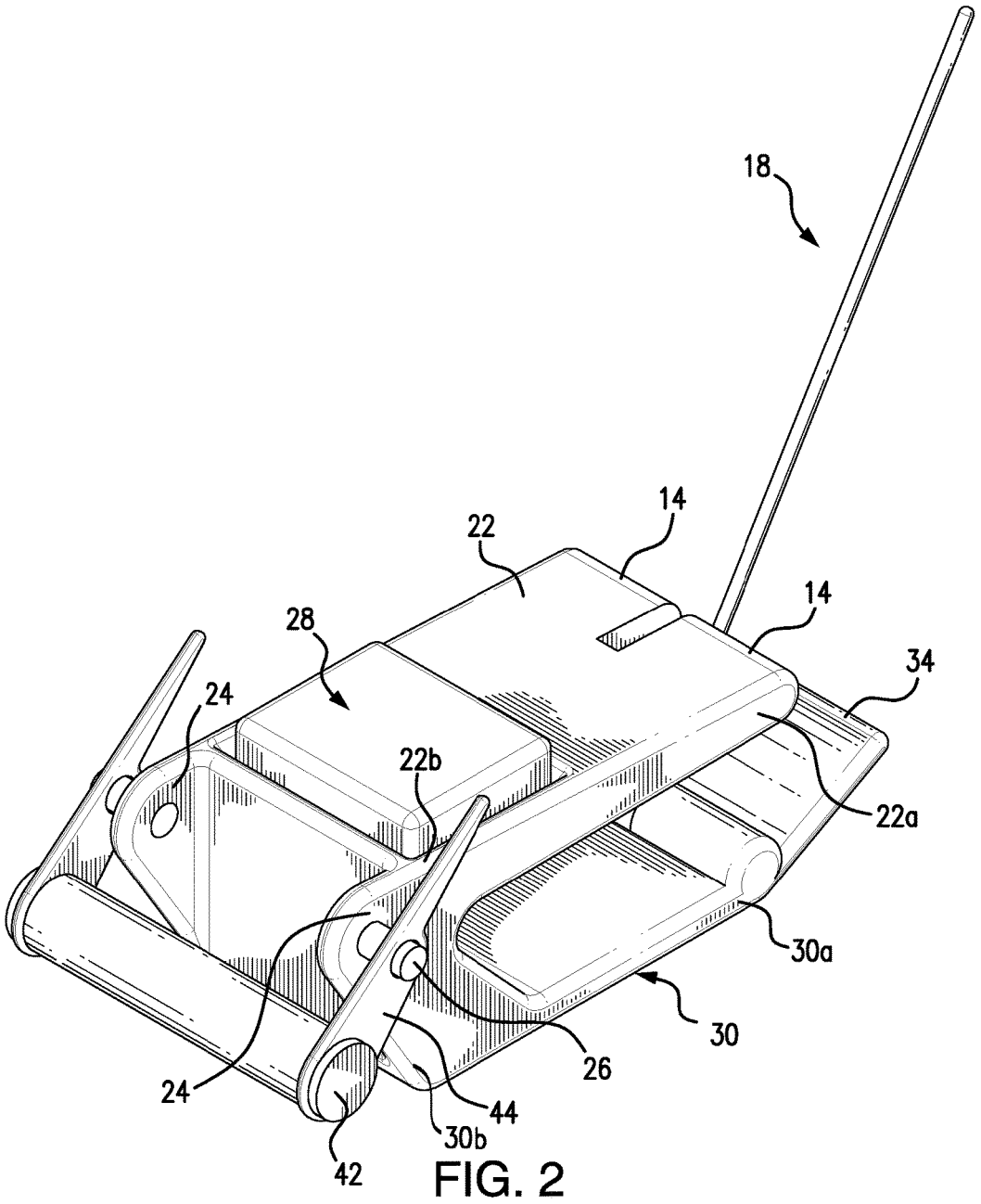
FIG. 2 right rear perspective view of an embodiment of the present invention

As illustrated in the embodiment depicted in FIGS. 1A-2, the body portion 12 is defined by an upper platform 22 having forward- and rearward-facing ends 22*a*, 22*b*. The forward-facing end 22*a* further comprises a pair of adjacent protrusions 14 defining an elongate forward-facing slot 16. The rearward-facing end 22*b* includes a pair of receivers 24, each receiver 24 having a pin 26 extending laterally therefrom. To provide comfort to the user, the upper platform 22 further comprises a knee pad 28 adapted for cushioning the weight of the user (See FIG. 3). As illustrated herein, the knee pad is substantially rectangular. Other shapes and configurations, however, are considered to be within the scope of the present disclosure, including the use of multiple pads to achieve the same result of cushioning the weight of the user.

With continued reference to the embodiment depicted in FIGS. 1A-2, the body portion includes a base portion 30 having forward- and rearward-facing ends 30*a*, 30*b* and an intermediate support region 32. As depicted herein, the base portion may rest flat on a surface. Alternatively, the base portion may be supported upon a series of legs resting on a surface or other suitable support means.

In an alternative embodiment, the exercise devise 10 comprises an upper platform 22 supported above a base portion 30 and a user support rod 18 operatively connected to the base portion 30. The user support rod is connected to the base portion at a position below the upper platform, thereby providing a greater range of motion as compared to existing exercise devices.

In one embodiment, and with continued reference to FIGS. 1A-2, the intermediate support region 32 is contiguous with the rearward-facing ends 22*b*, 30*b* of both the upper platform 22 and the base portion 30, thereby elevating the upper platform 22 above the base portion 30 and substantially parallel thereto. The intermediate support region may be static as depicted herein or, alternatively, capable of adjustment. For example, the intermediate support region may be adjustable to vary the height of the upper platform relative to the base portion. Further, the intermediate support region may also be at least partially pivotal to permit adjustment of the angle of the upper platform relative to the base or the extent to which the upper platform rests above the base, or both, thereby enabling a user to customize the exercise device to their particular needs.

The embodiments depicted in FIGS. 1A-1B also include an upwardly-depending range limiter 34 extending from the forward-facing end 30*a* of the base portion 30 and a substantially cylindrical housing 36 integrally formed between the base portion 30 and the range limiter 34. The range limiter 34 serves to limit the forward range of the user support rod 18, thereby preventing over-extension of, and subsequent injury to, the user.

As depicted in FIGS. 1A-1B, the user support rod 18 has opposing first 18*a* and second 18*b* ends and an intermediate extent 18*c* therebetween, the first end 18*a* extends upward from the cylindrical housing 36 and has first and second positions. In the first position, the intermediate extent 18*c* is positioned within the elongate slot 16. In the second position, the intermediate extent 18*c* is positioned against the range limiter 34. In one embodiment, the second end 18*b* of the user support rod 18 further comprises a cylindrical sleeve 18*d* oriented perpendicular to the user support rod 18. As depicted herein, the user support rod 18 may comprise a single rod. However, the use of multiple support rods is also envisioned to be within the scope of the present disclosure.

The user support rod may further comprise at least one handle or armrest for increasing a user's ability to grasp the support rod and/or for increasing comfort while exercising. Straps may also be provided for stabilizing a user's interaction with the device 10. Further, the length of the user support rod 18 may be adjustable to accommodate users of varying height and/or flexibility, or to provide a fine adjustment of the portions of the body to be strengthened.

Figure 7A:
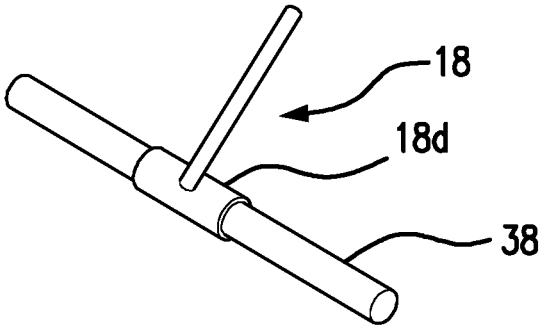
FIG. 7A is a perspective view of a user support rod in conjunction with a cylindrical shaft.
Figure 7B:
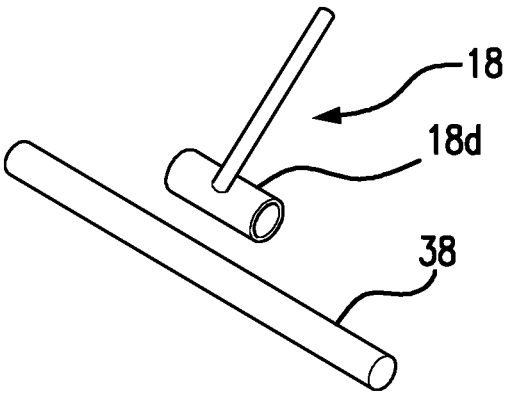
FIG. 7B is a perspective view of a user support rod disassembled from a cylindrical shaft.

With reference now to FIGS. 1, 7A, and 7B, and to enable the pivoting of the user support rod 18, one embodiment includes a cylindrical shaft 38 positioned within the substantially cylindrical housing 36. The shaft 38 is statically received by the cylindrical sleeve 18*d* proximate the second end 18*b* of the user support rod 18 and is capable of rotation about its longitudinal axis within the substantially cylindrical housing 36. The exercise device 10 may further comprise a torsion spring (not shown) or other resistance-altering means engaging at least one of the user support rod 18 and the cylindrical shaft 38 for increasing or decreasing the user support rod's 18 resistance to movement. Further, the resistance may be adjustable to accommodate the demands of a particular user. As depicted herein, and to enable a user to achieve optimal extension while exercising with the device, the user support rod 18 is pivotally connected to the device at a position below the plane upon which a user is supported. Such an orientation permits greater extension, and thus a greater total range of motion, as compared to existing devices.

In one embodiment, and as discussed above, the device 10 includes a leg support system 20 connected to the body portion 12 for engaging the user's legs. The support system 20 comprises a support beam 42 pivoting between first and second positions, the first position adapted to engage the user's legs (See FIG. 1A-2). Alternatively, the support system 20 may be static or selectively positionable. Further, the support beam may be substituted for a pair of ankle cuffs or other means for restraining and/or stabilizing a user's legs during operation of the exercise device 10.

As depicted herein, the support beam 42 is operably connected to the body portion 12 via a pair of pivotal arms 44 adapted for receiving the pins 26 extending laterally from the rearward-facing end 22*b* of the upper platform 22. In the first position the support beam 42 is above the upper platform 22, and in the second position the support beam 42 is below the upper platform 22. Other attachment means, however, are within the scope of the present disclosure.

Methods for Using Exercise Device

In addition to the embodiments of the exercise device disclosed herein, one embodiment of the invention includes a method for strengthening a user's hamstrings, leg muscles, and/or core abdominal muscles, the method comprising:

i. selecting an exercise device, wherein the exercise device comprises a body portion for supporting a user, the body portion having a pair of adjacent forward-facing protrusions defining an elongate slot; a user support rod pivotally connected to the body portion and adapted for pivoting into the elongate slot; and a leg support system operably connected to the body portion for engaging the legs of a user;
ii. mounting the exercise device in an upright position such that the user's knees are supported by the body portion and the user's legs engage the leg support;
iii. grasping the user support rod;
iv. leaning forward to achieve an extended position; and
v. returning to the upright position, wherein in the upright position the user support rod is positioned within the elongate slot.

Figure 3:
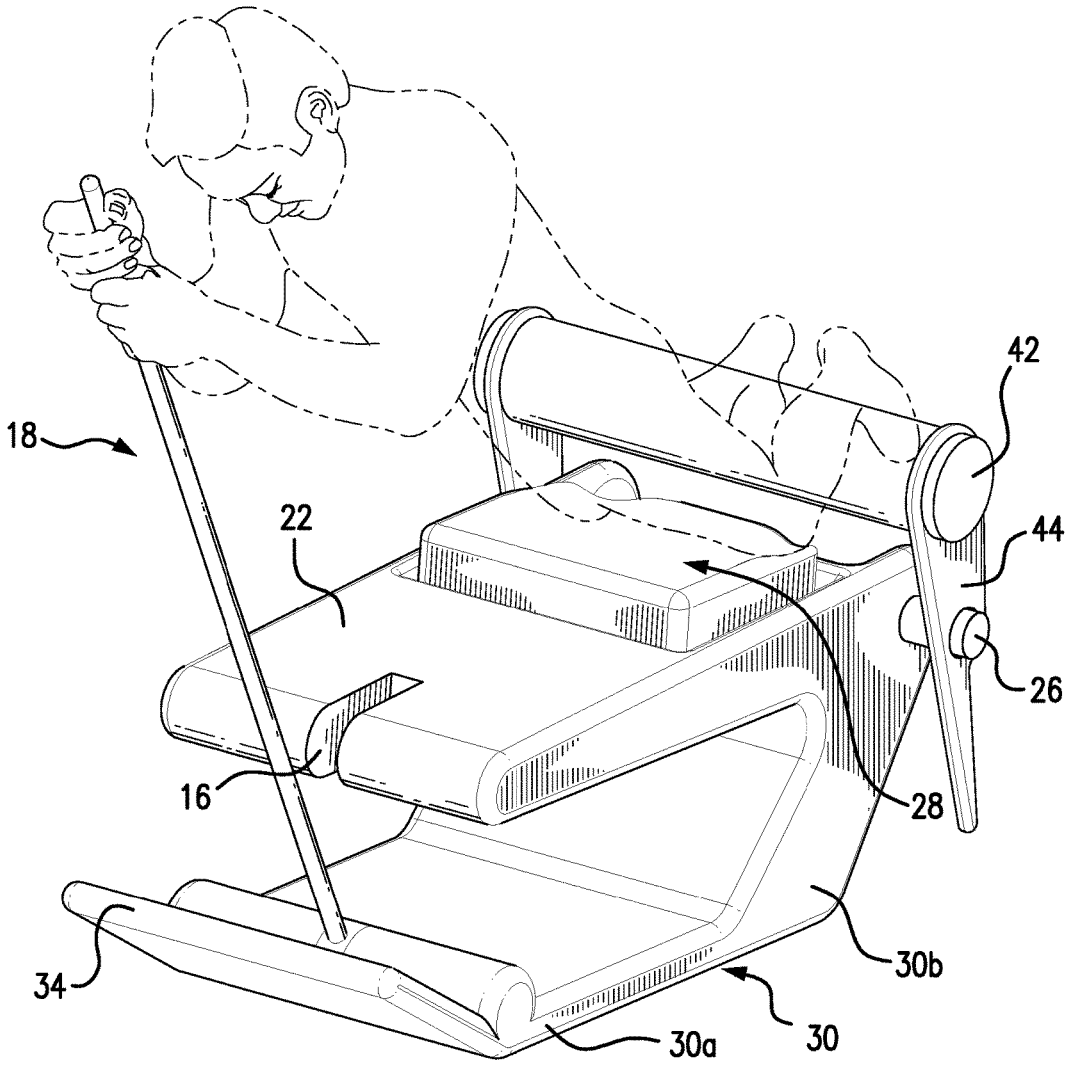
FIG. 3 is a left side perspective view of an embodiment of the invention in conjunction with a user.
Figure 4:
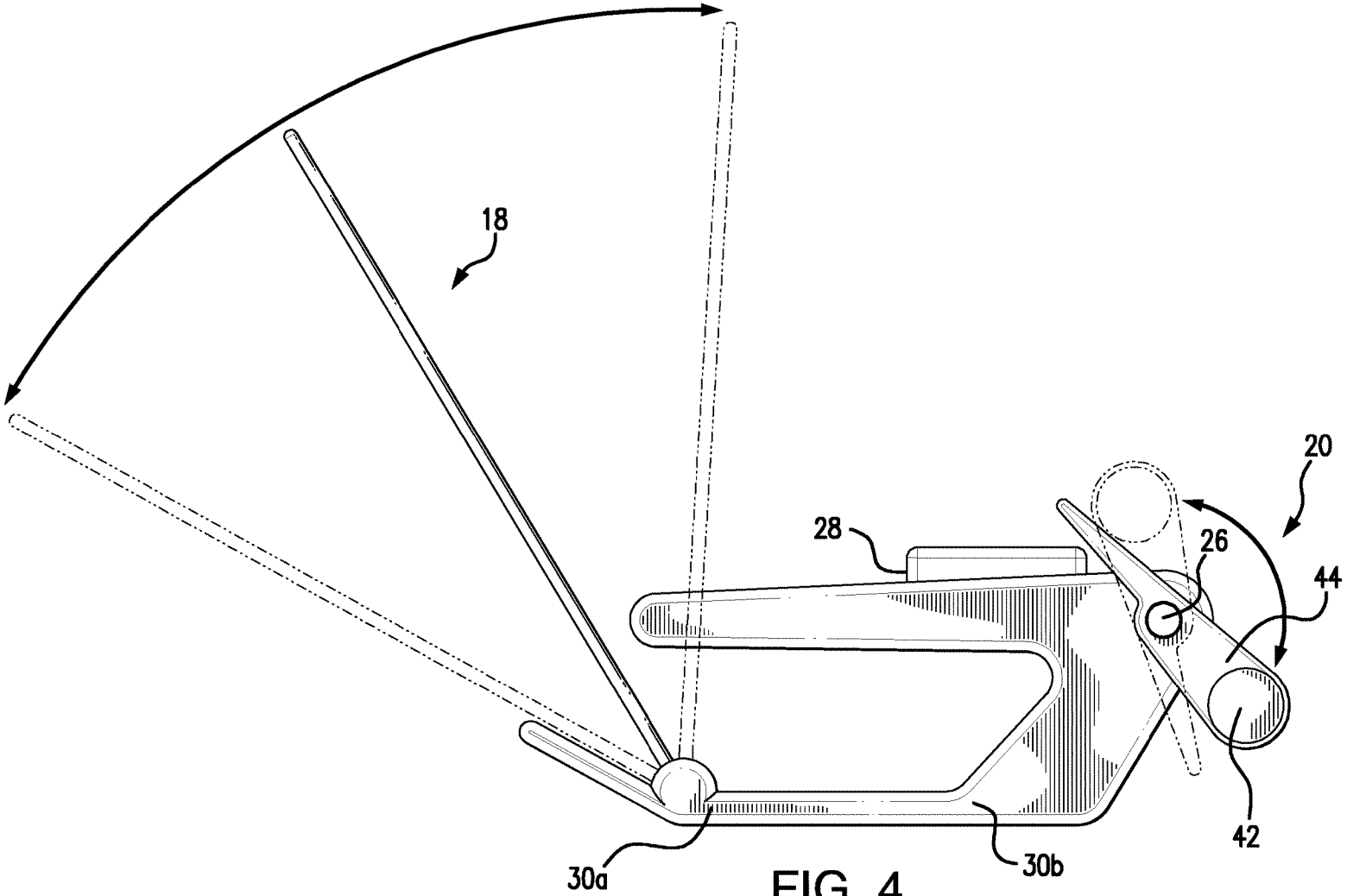
FIG. 4 is a left side elevational view of an embodiment of the invention, wherein the right side is a mirror image thereof.
Figure 5:
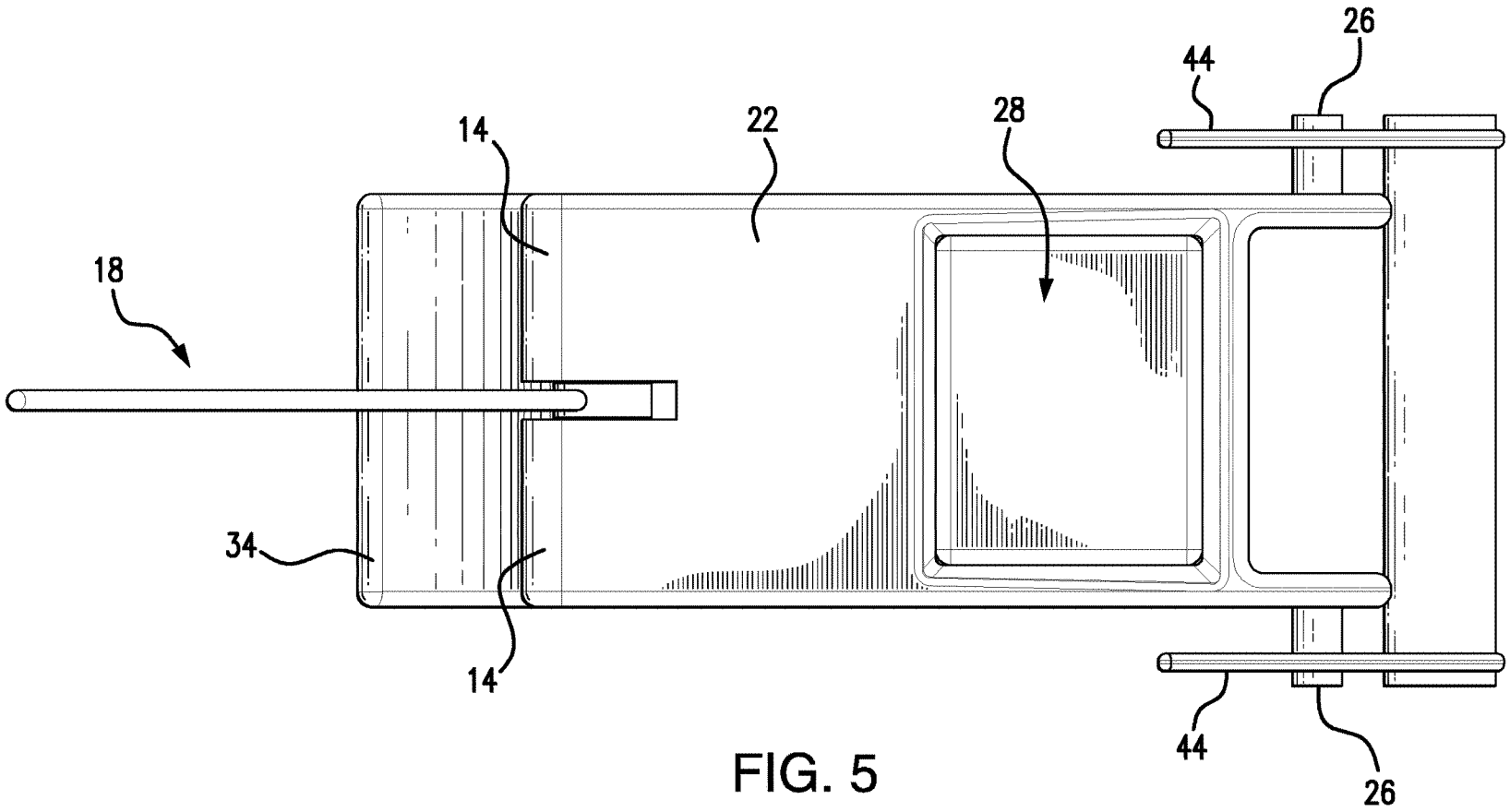
FIG. 5 is a top plan view of an embodiment of the invention.
Figure 6:
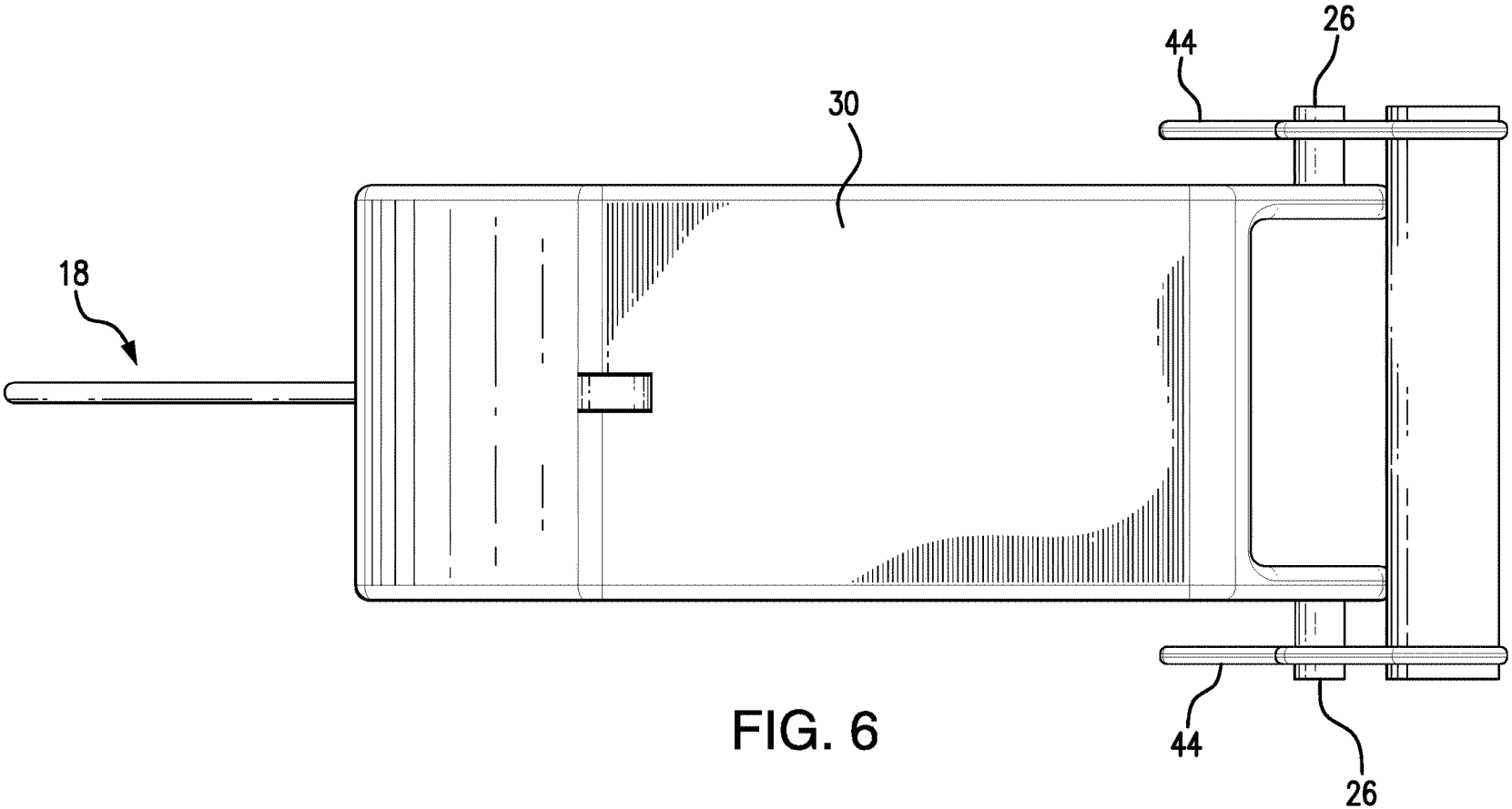
FIG. 6 is a bottom plan view of an embodiment of the present invention.

As depicted in FIG. 3, the method described herein may further include placing a user's legs in contact with a support system operable with the body portion of the exercise device. In one embodiment, the body portion further comprises an upper platform; a base portion; and an intermediate support region therebetween. As described above, the intermediate support region elevates or supports the upper platform above the base portion. Further, while the adjacent forward-facing protrusions may be integral with the upper platform, other configurations are considered to be within the scope of the present disclosure, including the use of detachable forward protrusions for ease of adjustment or transport.

As described herein, the intermediate support region may be contiguous with rearward-facing portions of both the upper platform and the base portion. Additionally, a range limiter extending from the forward-facing end of the base portion may be provided. In embodiments containing a range limiter, the leaning forward step may further comprise contacting the range limiter with the user support rod.

In yet another embodiment, the leg support system has first and second positions, the first position adapted to engage the user's legs. The leg support system may be coupled to the body portion of the device by a pair of pivotal arms. The pivotal arms may be operably connected to the rearward-facing portion of the upper platform.

Although this disclosure has been described in terms of certain embodiments and generally associated methods, alterations and permutations of these embodiments and methods will be apparent to those skilled in the art. Accordingly, the above description of example embodiments does not constrain this disclosure. Other changes, substitutions, and alterations are also possible without departing from the spirit and scope of this disclosure.

What is claimed is:

1. An exercise device for strengthening a user's hamstrings, the exercise device comprising:

a body portion defined by an upper platform having forward- and rearward-facing ends, the forward-facing end further comprising a pair of adjacent protrusions defining an elongate forward-facing slot, the rearward-facing end including a pair of receivers, each receiver having a pin extending laterally therefrom, the upper platform further comprising a knee pad adapted for cushioning a weight of the user;

a base portion having forward and rearward facing ends; and an intermediate support region contiguous with the rearward-facing ends of both the upper platform and the base portion, thereby elevating the upper platform above the base portion;

an upwardly-depending range limiter extending from the forward-facing end of the base portion;

a housing integrally formed between the base portion and the range limiter;

a user support rod for grasping by the user, the user support rod having opposing first and second ends and an intermediate extent therebetween, the first end extending upwardly from the housing and having first and second positions, wherein in the first position the intermediate extent is positioned within the elongate forward facing slot, and wherein in the second position the intermediate extent is positioned against the range limiter, the second end of the user support rod further comprising a cylindrical sleeve oriented perpendicular to the user support rod;

a cylindrical shaft statically received by the cylindrical sleeve and rotationally secured within the housing; and a support system engaging the user's legs, the support system including a support beam having first and second positions, the first position adapted to engage the user's legs, and a pair of pivotal arms operably connecting the support beam to the body portion via the pins extending laterally from the rearward-facing end of the upper platform, wherein in the first position the support beam is above the upper platform, and wherein in the second position the support beam is below the upper platform.

2. An exercise device comprising:

a body portion for supporting a user, wherein the body portion comprises an upper platform, a base portion, and an intermediate support region therebetween, the intermediate support region supporting the upper platform above the base, wherein the upper platform has a pair of adjacent forward-facing protrusions defining an elongate slot;

a user support rod pivotally connected to the body portion and adapted for pivoting into and out of the elongate slot;

a leg support system operably connected to the body portion for engaging legs of the user; and wherein the upper platform remains stationary relative to the base portion when the user support rod is pivoted.

3. The exercise device as described in claim 2, wherein the pair of adjacent forward-facing protrusions are integral with the upper platform.

4. The exercise device as described in claim 3, wherein the leg support system is connected to a rearward-facing portion of the body portion.

5. The exercise device as described in claim 4, wherein the support system comprises a support beam composed of one continuous member.

6. The exercise device as described in claim 5, wherein the support beam has first and second positions, the first position adapted to engage the user's legs.

7. The exercise device as described in claim 6, further comprising a pair of pivotal arms operably connecting the support beam to the body portion.

8. The exercise device as described in claim 3, further comprising a range limiter extending from a forward-facing end of the base portion, wherein the user support rod releasably contacts the range limiter when the user support rod is rotated into a second, fully extended, position.

9. The exercise device as described in claim 8, further comprising a housing integrally formed between the base portion and the range limiter.

10. The exercise device as described in claim 9, wherein a portion of the user support rod is positioned within the housing.

11. The exercise device as described in claim 3, wherein the intermediate support region is contiguous with rearward-facing portions of both the upper platform and the base portion.

12. A method for strengthening a user's hamstrings, the method comprising:

selecting an exercise device, wherein the exercise device comprises a body portion for supporting a user, the body portion having a pair of adjacent forward-facing protrusions defining an elongate slot;

a user support rod pivotally connected to the body portion and adapted for pivoting into the elongate slot; and a leg support system operably connected to the body portion for engaging the legs of a the user;

mounting the exercise device in an upright position such that the user's knees are supported by the body portion and the user's legs engage the leg support;

grasping the user support rod;

leaning forward to achieve an extended position; and returning to the upright position, wherein in the upright position the user support rod is positioned within the elongate slot.

13. The method as described in claim 12, wherein the body portion further comprises an upper platform;

a base portion; and an intermediate support region therebetween, the intermediate support region elevating the upper platform above the base portion;

wherein the pair of adjacent forward-facing protrusions are integral with the upper platform.

14. The method as described in claim 13, wherein the exercise device further comprises a range limiter extending from a forward-facing end of the base portion.

15. The method as described in claim 14, wherein the leaning forward to achieve an extended position includes contacting the range limiter with the user support rod.

16. The method as described in claim 15, wherein the leg support system has first and second positions, the first position adapted to engage the user's legs.

17. The method as described in claim 16, further comprising a pair of pivotal arms operably connecting the leg support system to the body portion.

18. The method as described in claim 17, wherein the pair of pivotal arms are operably connected to the rearward-facing portion of the upper platform.

19. The method as described in claim 13, wherein the intermediate support region is contiguous with rearward-facing portions of both the upper platform and the base portion.

20. The method as described in claim 12, wherein the leg support system is connected to a rearward-facing portion of the body portion.

* * * * *